United States Patent [19]

Feil et al.

[11] Patent Number: 4,854,102

[45] Date of Patent: Aug. 8, 1989

[54] SUB-ROOF FOR A ROOF COVERED WITH ROOFING BOARDS

[76] Inventors: Eugen Feil, Lange Strasse 29, D-7084 Westhausen; Gerd Neumann, Attenzell 50, D-8079 Kipfenberg; Wolfgang Graser, Mittelsetzring 56, D-8729 Zeil; Horst Friedrich, Kriegsreuth, D-8662 Helmbrechts, all of Fed. Rep. of Germany

[21] Appl. No.: 71,756

[22] Filed: Jul. 9, 1987

[30] Foreign Application Priority Data

Jul. 11, 1986 [DE] Fed. Rep. of Germany ..... 3623428

[51] Int. Cl.[4] ..... E04B 1/88

[52] U.S. Cl. ..... 52/535; 52/409

[58] Field of Search ..... 52/519, 541, 560, 539, 52/536, 518, 533, 535, 409, 408

[56] References Cited

U.S. PATENT DOCUMENTS 954,520 4/1910 Kester ..... 52/536
2,110,485 3/1938 Hunt ..... 52/541

FOREIGN PATENT DOCUMENTS 1932532 2/1966 Fed. Rep. of Germany .
2325831 11/1974 Fed. Rep. of Germany .
2349710 6/1977 Fed. Rep. of Germany .
2342347 3/1980 Fed. Rep. of Germany .
3001339 7/1981 Fed. Rep. of Germany .
3441316 5/1986 Fed. Rep. of Germany .
2455660 4/1980 France .
2562588 4/1984 France .

*Primary Examiner*—John E. Murtagh
*Attorney, Agent, or Firm*—Dority & Manning

[57] ABSTRACT

A sub-roof for roofs with roofing boards consisting of a plurality rectangular insulating boards (1) overlapping each other in direction of the slope of the roof. Each insulating board has a parallel plane central section (3), integral with a wedge-shaped board section (2) on the ridge side and a wedge-shaped board section (4) on the eaves side, the thickness of which increases towards the middle of the board. The thickness of the board sections (2 and 4) on the ridge side and on the eaves side at their edge towards the central board section (3) is at least equal to the thickness of said central board portion (3) and, when thicker boards are used, reaches said thickness after going through a step (11 and 12). The insulating boards (1) are placed so that they constitute an offset double or multiple covering. Due to the wedge-shaped multiple overlap the rows of insulating boards can be shifted within the longitudinal direction, for example, to adapt to different batten intervals or spacing, whereby the effective insulating layer thickness of the sub-roof does not change noticeably and tightness is not affected.

13 Claims, 3 Drawing Sheets

SUB-ROOF FOR A ROOF COVERED WITH ROOFING BOARDS

BACKGROUND OF THE INVENTION

The instant invention relates to a sub-roof with roofing boards for covered roofs.

To build up a sub-roof, an insulating board is disclosed in DE-GM 1,932,832 which hangs by an upper projection on a roof lath, whereby the upper portion of an insulating board which is already installed nearer to the eaves is partially overlapped. A crosspiece extends along the lower area of each insulating board for the engaging of the projections of roof tiles. The crosspieces are cut by water channels. An overlapping profile is attached to the lateral edges of the insulating boards to render the lateral abutments water-tight.

A sub-roof construction with the above insulating board has a disadvantage in that damages are often inflicted upon the insulating boards as early as during open construction work, e.g. breaking away of the relatively thin, overlapping lateral parts, and this leads to low-temperature bridges and to the loss of water-tightness in the sub-roof. This roof construction is practical only with relatively thin insulating boards, but with the greater insulating thicknesses in demand today, roofing of such an overall insulating layer thickness leads to a step-like surface with high steps, depending upon the thickness of the insulating boards, so that a desired uniform overall thickness of the insulation, especially in the areas of overlaps, is out the question. A further disadvantage results from the fact that when the thicker insulating layers are used, the individual insulating boards tip away from the roof when they are laid on steeper roofs, especially when the roofing tiles are hooked in. With flat roofs on the other hand, the problem arises that when thicker insulating layers are used, the insulating boards are placed in a nearly horizontal position because of the overlaps, so that water may back up and the watertightness of the roof is then no longer ensured. The lack of wind tightness is a further disadvantage, as transverse overlap is minimal.

A further, known embodiment of insulating boards used to built up a sub-roof is disclosed in DE-PS 2349 710. These boards are engaged over their entire width, as seen vertically to the eaves, between the roof battens and their lateral surface on the eaves side is supported by the ridge-side lateral surface of the roof batten below. Stepped mortises are provided in the area of cross-overlap so that an essentially planar upper and lower surface of the sub-roof is created. The disadvantage of this design is the great fragility of the profiled lateral edges, which may have, as a consequence, that the sub-roof is no longer tight and no longer insulates in areas where it has been damaged. When thicker insulating boards are used, there is the further danger that these may tip out of the roof surface after or during installation of the roof tiles. For the drainage of the sub-roof, a water guiding groove must be installed at the lowest point of the stepped mortises, leading from there at an upward slant to the insulating board below. With thicker boards and flatter roof surfaces these water guiding grooves are slanted ever more horizontally, so that water may back up. Tightness against water and wind must, on the whole, be ensured by complicated, easily damaged and overlapping configurations at the edges. Storm-proofing, e.g. roofing with insulating board as a provisional measure, is only possible with the help of expensive additional means.

It is, however, a particular disadvantage of the known boards that insulating boards of different dimensions must be used with different batten intervals. It is known that batten intervals are different for different roof tile products and measure, for example, 32 to 36 cm for roof pan covers. It is, therefore, necessary to manufacture boards in narrow gradations within that range, to keep them in stock, to take them into consideration in planning, and to order them, all of which is expensive. Left-overs in the hands of artisans and roofers are difficult to distinguish from each other, are difficult to store, and thus to use up. Because of the complicated configuration of the edges, cut-off ends, or partially cut, insulating boards can hardly ever be used again, so that much waste is produced in cutting.

Insulating boards, which are wider than the given batten interval, cannot be used. If insulating boards are used which are too narrow for the batten, interval gaps occur and, as a result, weak spots in the insulation are thus created in the area of stepped mortise overlap.

SUMMARY OF THE INVENTION

It is the objective of the instant invention to create a sub-roof where the insulating boards used to constitute it are of an especially simple configuration, unlikely to be damaged, yet providing reliable insulation A sub-roof for roofs covered with roofing boards, comprises rectangular insulating boards, overlapping each other in the direction of the eaves. Each of the boards is provided with a parallel plane central section upon which a wedge-shaped board section verges on the ridge side and on the eaves side. The thickness of the wedge-shaped board section increases towards the middle of the board, whereby the upper side of the board section, pointing to the ridge, lies in one, and the same, plane with the upper side of the central board section. The underside of the board section pointing to the eaves, lies in one, and the same plane, with the underside of the central board section. The sum of the lengths of the central board section and the board section pointing to the eaves (measured in direction of the slope) is at least equal to the length of the board section pointing to the ridge. The edges of board sections pointing to the eaves and to the ridge, touching the central board section, are at least as thick as said central board section, and, with boards of greater thickness, the transition is insteps. The insulating boards are furthermore laid out so as to constitute a double or multiple roof covering.

The insulating boards can be of any desired width suitable and advantageous for manufacture and assembly. The board length also depends upon the number of fastening points or support points, e.g. battens, which are to be bridged by one insulating board, the desired number of roof covering layers, the desired thickness of the overall insulating board layer, and the like.

Water tightness of a sub-roof made with the insulating boards according to the invention is achieved, on the one hand through the fact that the insulating board cover is at least double, and on the other hand, to the off-set installation of the lateral abutments. The fact that the overlaps can be very long and very wide also ensures wind tightness.

Because of the wedge-shaped superposition of the overlaps, water is spilled off from one board surface directly upon the insulating board below. The inclination of the water course is approximately equal to the pitch of the roof, i.e. so that the problems of water back-up encountered with relatively flat roofs do not arise. Furthermore, the wedge-shaped overlap prevents weak spots from being created in the insulation when the rows of insulating boards are shifted in wedge direction, and the overall insulating layer thickness changes very little. A great number of insulating boards in many graduated lengths are not needed for different applications.

Due to the wide overlap, only low tipping moments are created so that the sub-roof is also very well suited for steep roofs.

Since the central board section of the insulating board is always covered by the next insulating board above it, simple fasteners, e.g. wide-headed nails can be used to fasten the insulating board in a storm-proof manner, without low-temperature bridges and without danger of corrosion. This also permits building up a temporary, water tight roof with insulating boards only, before the subsequent covering with roofing material, e.g. roofing tiles.

Neither broken edges nor holes in the insulating boards can lead to water leaks or to a complete loss of insulation in the affected area, as this could only occur in the highly unlikely case where the other two adjoining insulating boards used as covering in that area are also damaged. This high degree of water tightness, or the capability of shedding great masses of water, makes the sub-roof well suited for absorption roofs (heat exchanger of a solar heating installation, between insulation and tiles).

Complicated and easily damaged lateral mortise configurations to drain off water are not required due to the offset and extensive overlapping of the insulating boards. Boards, with smooth undersides on the board section pointing to the ridge, can be applied directly on the timbering and, if sufficiently wide, on rafters. Furthermore, the insulating boards can also be used as wall covering. If the surface of the board section pointing to the eaves is smooth, it is possible to install slate or asbestos plates, cardboard, sheet, or the like on the overall smooth surface of the sub-roof.

The insulating board section pointing to the ridge, and the insulating board sections pointing to the eaves, are identical in their cross-section and are installed symmetrically in relation to the center of the board. Such an insulating board has, therefore, no inside or outside and can, therefore, be manufactured easily and can also be stacked, packed, and installed easily.

Since the customary, required batten intervals or spacing range from 32 cm (16 cm for double crown tile roofs) to 38 cm, the selection of these lengths, preferably approximately 36 cm for the section pointing to the ridge, as well as for the sections pointing to the eaves, produces a universally usable insulating board. The length of the central section should be about half that length for a two-and-a-half time overlap.

An especially preferred embodiment is where the underside of the insulating board is fashioned so that it can be hung from a roof lath and the upper side of the insulating board is fashioned so that roof covering boards can be hung from it.

With the additional batten or mortise on the upper side of the section pointing to the eaves, a universally usable insulating board is created which is suitable for all possible roofing tiles, such as roof pans, double depression interlocking tiles, or the like where batten intervals vary and which is, furthermore, suitable for crown tile roofing.

The drainage grooves prevent water from stagnating in the wedge-shaped steps. In addition, the drainage grooves provide back ventilation to the roof above.

The drainage grooves become wider at their side pointing to the eaves so that a nozzle-like effect and an acceleration of an airstream is produced for back ventilation of the roof.

In order to improve wind tightness of the sub-roof, the lateral edges are provided with projections which engage the adjoining insulating roofing boards being installed. This prevents wind from reaching the inside of the building directly through a straight butt joint.

A further improvement of wind tightness is achieved where the projections on the lateral edges of the insulating boards are slightly offset in relation to each other in the sense of the slope. Hook-like connections are thus created and are pressed together tightly when traction is exerted on the installed boards.

BRIEF DESCRIPTION OF THE DRAWINGS

The characteristics and advantages of embodiments of the invention are explained in further detail in a the drawings where.

DETAILED DESCRIPTION OF THE DRAWING

Figure 1:
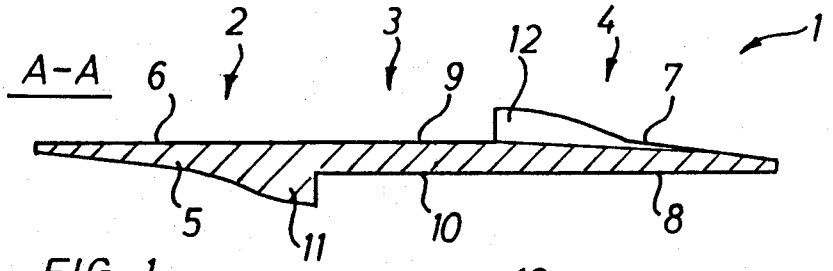
FIG. 1 is a longitudinal section taken (along line A—A of FIG. 3) through a first embodiment of an insulating board.
Figure 4:
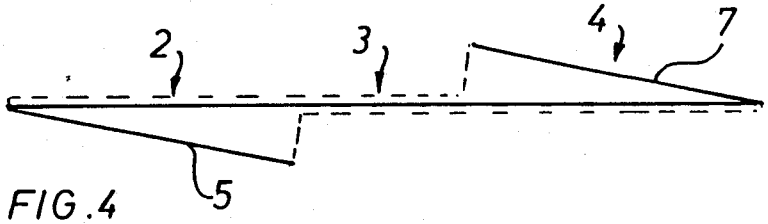
FIG. 4 is a schematic representation of the basic shape of the side view of an insulating board.

FIG. 1 is a longitudinal section of an insulating board 1 seen from the side. The basic Z shape, as indicated again abstractly in FIG. 4, can be recognized here.

Figure 6:
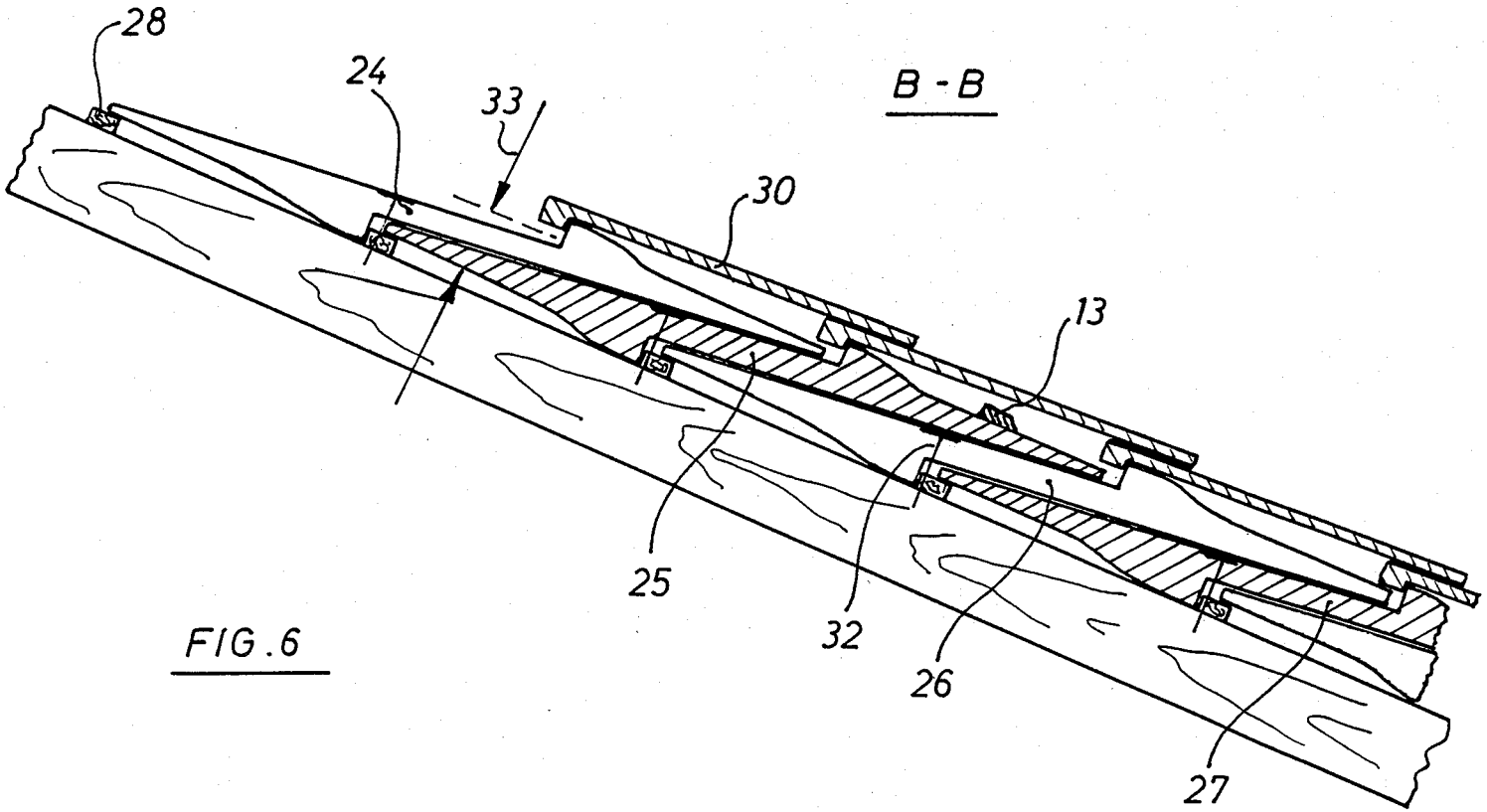
FIG. 6 is a section and side view (taken along line B—B of FIG. 5) of a plurality of installed insulation boards.

The insulating board 1 consists of a board section 2 pointing to the ridge (in relation to the already covered roof portion shown in side view in FIG. 6), of a central board section 3 and of a board section 4 pointing to the eaves.

The board section 2 pointing to the ridge is wedge-shaped, with an underside 5 and an upper side 6. The board section 4 pointing to the eaves is also wedge-shaped and has an upper side 7 and an underside 8. The central board section 3 is given an upper side 9 and an underside 10 which is parallel to it. The upper side 9 is an extension of the upper side 6 and the underside 10 is an extension of the underside 8.

Near the thick end of the wedges, raised portions form steps 11 and 12 on the underside 5 and on the upper side 7, in the area of the step-like abutment of the wedges. (In the stylized form f FIG. 4 the rising of the cross-rail is not shown.) These steps 11 and 12 can be made in the form of attached ribs or, as shown in FIG. 1, can be made in the form of arched raised portions verging into the sides 5 and 7.

Figure 2:
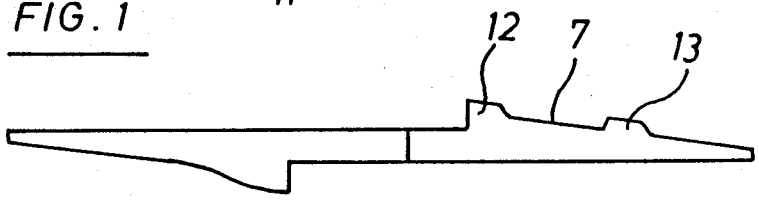
FIG. 2 is a side view of a second embodiment of an insulating board.

In the second embodiment according to FIG. 2 the basic shape as well as the form of the board section 2 pointing to the ridge and of the central board section 3 are identical with those of the embodiment in FIG. 1.

Only on upper side 7, in addition to step 12, a lath 13 is added near the middle of upper side 7.

Figure 3:
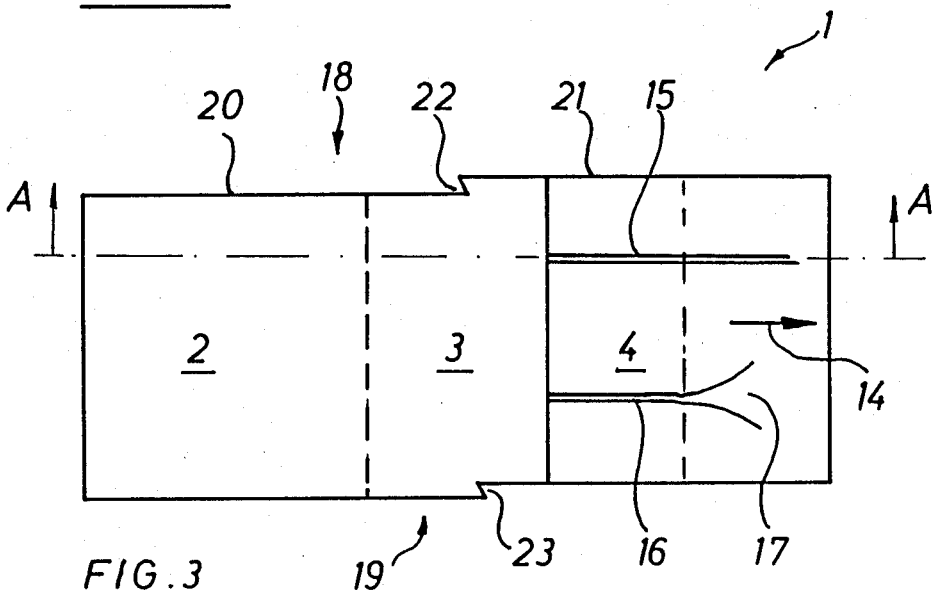
FIG. 3 is a top view of an insulating board.

FIG. 3 shows a top-view of the insulating board 1 according to FIG. 1. Here again, the three board sections, i.e. section 2 pointing to the ridge, the central board section 3 and the board section 4 pointing to the eaves can be recognized, with an arrow indicating the direction of slope 14 on an installed board.

The drainage grooves 15, 16 run through the raised wedge and step 12 (or also lath 13) in the direction of slope 14. Only two drainage grooves 15, 16 are shown here, but additional ones can be provided as required so that the steps 12 and laths 13 could be represented as humps going across the roof. The drainage groove 15 is straight while the drainage groove 16 is given a different configuration, with a lower, nozzle-like widening 17 to accelerate an air stream for back ventilation of the roof.

the lateral edges 18, 19 of the insulating board 1 are offset in their design, with the upper lateral area 20, on the right side as seen from above, being offset to the left, as seen from above, against a lower lateral edge 21 on the lower right side, so that the oblique projections 22, 23 are formed as a result. FIG. 3 shows that the projection 23 is slightly lower, towards the eaves, than projection 22. When the projection 23 of a second board engages the projection 22 of the board shown and when the roof covering exerts traction on the second board, the two projections are tightly pressed into each other.

Figure 5:
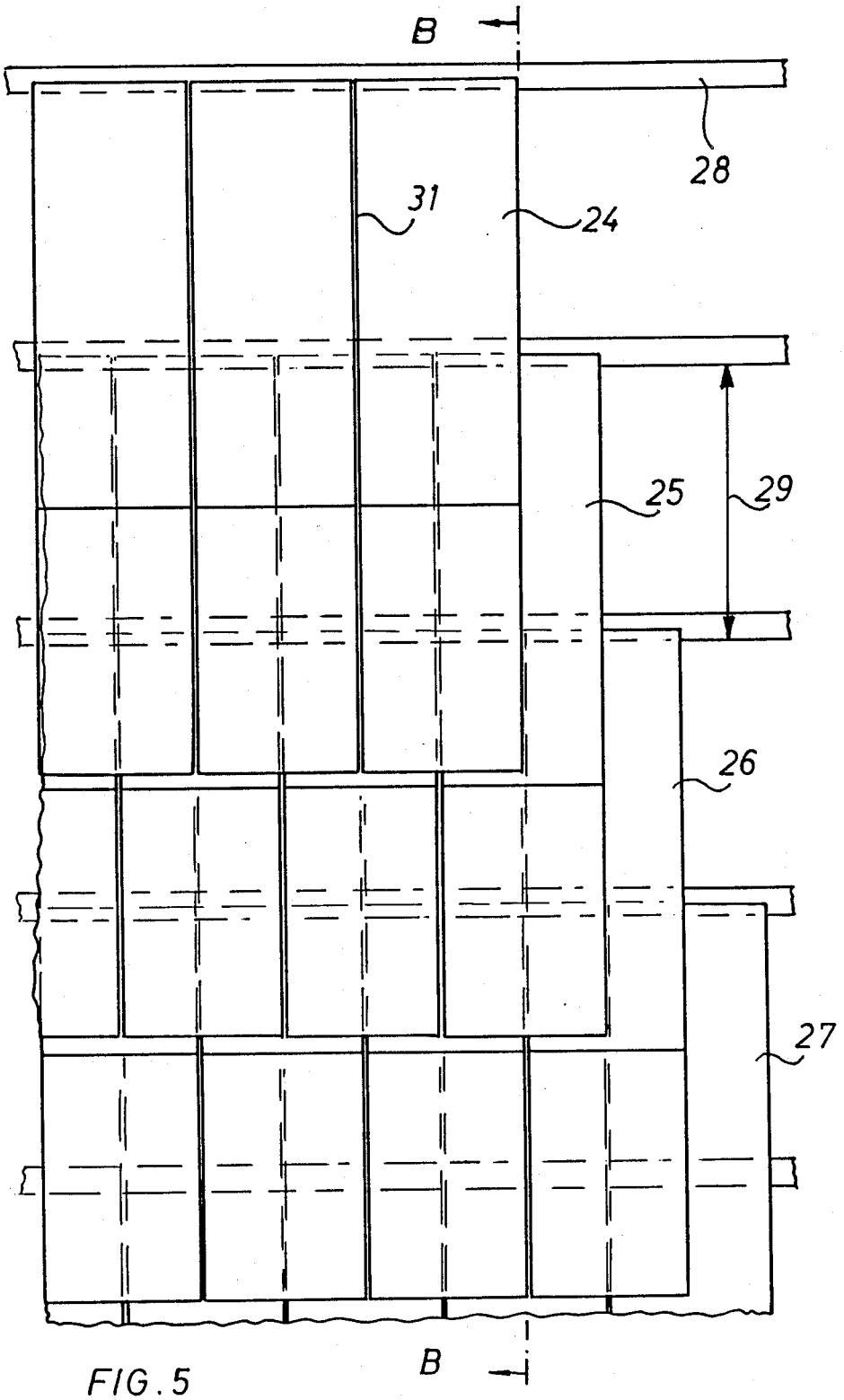
FIG. 5 is a top view of a plurality of installed insulation boards.

The way in which roofing is installed and the function of the sub-roof are shown in FIGS. 5 and 6.

In FIG. 5, four rows 24, 25, 26, 27 of insulating boards 1 are shown on a substructure consisting of roof battens 28 (the insulating boards are shown without lateral projections 22, 23). It can already be seen from this drawing that the board section 2 pointing to the ridge and the board section 4 pointing to the eaves are somewhat longer than the interval or space 29 between roof battens, and that the central board section 3 is about half as long as the interval or space 29 between roof battens, so that a wide overlap results overall, over the insulating board which is directly below another insulating board, as well as over the following insulating board further below, using about half the board section pointing toward the eaves. This can also be seen in FIG. 6 which shows a cross-section along line B—B of FIG. 5, and where the roof tiles 30 have already been laid down over insulating board rows 24 to 27.

FIG. 5 furthermore shows through the abutments 31 how the insulating board rows 24 to 27 are covered, and this covering, together with the wide overlaps of the insulating boards below, ensure the water-tightness of the entire sub-roof.

The sub-roof is installed row by row, starting from below, so that the individual insulating boards can be fastened and nailed down with fasteners such as wide-head nails 32, for example, to become storm-proof. The boards are, in that case, preferably, fastened at their center so that the insulating boards cannot be lifted even by strong winds and cannot break away. The nails 32 are furthermore covered in turn by the next row of boards so that corrosion damage and low-temperature bridges are avoided.

It can easily be see from FIG. 6 that the individual insulating board rows 24 to 27 would be somewhat closer together or further apart if the batten intervals 29 were somewhat greater or somewhat smaller. Because of the wide, wedge-shaped overlapping the change in the average effective insulating layer thickness 33 of the sub-roof 33 would be insignificant. Such an adaptation to different batten intervals does not lead to gaps or weak spots in the insulating layer.

An insulating board with a lath 13 is shown in insulating board row 25 (FIG. 6). When such insulating boards, as in the second embodiment according to FIG. 2 are used, it can be seen that double crown tile roofing is possible.

With the invention it is found that an insulating board with a relatively simple configuration can be used to produce a water-tight sub-roof which is suitable for flat as well as steep roofs and for different roof batten intervals.

We claim:

1. A sub-roof having a ridge and eaves, comprising a plurality of overlapping generally rectangular insulating boards, each of which comprises:

(a) a central section having upper and lower surfaces extending parallel to each other, and having a uniform thickness;

(b) a lower edge section extending in the direction of said eaves, having a lower surface integral with, and extending in the same plane as, the lower surface of said central section and an upper surface tapering to the edge of said lower edge section and having a thickness at the point said lower section joins said central section which is greater than the thickness of said central section to form a step on said upper surface of said lower edge section; and (c) an upper edge section extending in the direction of said ridge, having an upper surface integral with, and extending in the same plane as, the upper surface of said central section and a lower surface tapering to the edge of said upper edge section and having a thickness at the point said upper section joins said central section which is greater than the thickness of said central section to form a step on said lower surface of said upper edge section.

2. A sub-roof as set forth in claim 1, wherein said upper and said lower sections are mirror images in cross-section and are symmetrical in relation to the central section of the board.

3. A sub-roof as set forth in claim2, wherein the length of said upper section and that of said lower section is between 32 and 38 centimeters and the length of said central section is about half of the length of said upper and said lower sections.

4. A sub-roof as set forth in claim 1, wherein the lower surface of said upper section verges into said step at the point said upper section joins said central section so that said board can be fastened to said roof.

5. A sub-roof as set forth in claim1, wherein the upper surface of said lower section verges into said step at the point said lower section joins said central section so that roofing boards can be supported by said step.

6. A sub-roof as set forth in claim 5, wherein said upper side of said lower section is provided with a lath extending transversely of said board for supporting roofing boards.

7. A sub-roof as set forth in claim 1, wherein the upper surface of said lower section is provided with at least one drainage groove extending longitudinally of said lower section.

8. A sub-roof as set forth in claim 7, wherein said drainage groove diverges in width towards the lower edge of said lower section.

9. A sub-roof as set forth in claim 1, wherein each of the lateral edges of said boards is provided with a step for interlocking with the lateral edges of adjacent boards on said roof.

10. A sub-roof as set forth in claim 9, wherein the steps at the lateral edges of said insulating boards are slightly offset from each other.

11. A sub-roof as set forth in claim 1, wherein at least one drainage groove is formed longitudinally of said upper surface of said lower section.

12. A sub-roof having a ridge and eaves, comprising a plurality of overlapping generally rectangular insulating boards, each of which comprises:

(a) a central section having upper and lower surfaces extending parallel to each other, and having a uniform thickness;

(b) a lower edge section extending in the direction of said eaves, having a lower surface integral with, and extending in the same plane as, the lower surface of said central section and an upper surface tapering to the edge of said lower edge section and having a thickness at the point said lower section joins said central section not less than the thickness of said central section;

(c) an upper edge section extending in the direction of said ridge, having an upper surface integral with, and extending in the same plane as, the upper surface of said central section and a lower surface tapering to the edge of said upper edge section and having a thickness at the point said upper section joins said central section not less than the thickness of said central section; and (d) at least two offset lateral edges on each side of said insulating boards having a step portion at the point where said edges meet for interlocking with the lateral edges of adjacent boards on said roof.

13. A sub-roof is set forth in claim 12, wherein the steps at opposed lateral edges of said insulating boards are slightly offset from each other.

* * * * *